US008292070B2

(12) United States Patent
Morris-Jones et al.

(10) Patent No.: US 8,292,070 B2
(45) Date of Patent: Oct. 23, 2012

(54) SYSTEM AND METHOD FOR GREEN AND RAPID PAPER PACKAGING

(75) Inventors: Stephen Morris-Jones, Welwyn (GB); James Richardson, Enfield (GB)

(73) Assignee: Xerox Corporation, Norwalk, CT (US)

( * ) Notice: Subject to any disclaimer, the term of this patent is extended or adjusted under 35 U.S.C. 154(b) by 379 days.

(21) Appl. No.: 12/272,904

(22) Filed: Nov. 18, 2008

(65) Prior Publication Data

US 2010/0124480 A1 May 20, 2010

(51) Int. Cl.
*B65D 85/00* (2006.01)

(52) U.S. Cl. ..... 206/215; 294/156

(58) Field of Classification Search ..... 206/494, 206/451, 442, 215, 449, 752, 754, 772; 229/117.14; 383/6, 10, 14, 17, 105, 109, 113, 114, 107; 220/752, 754, 772; 294/151, 156, 152
See application file for complete search history.

(56) References Cited

U.S. PATENT DOCUMENTS

| | | | | |
|---|---|---|---|---|
| 2,435,743 | A * | 2/1948 | Geimer | 383/113 |
| 3,684,086 | A * | 8/1972 | Harrison | 206/449 |
| 3,872,997 | A * | 3/1975 | Armstrong et al. | 221/20 |
| 4,378,905 | A * | 4/1983 | Roccaforte | 229/117.12 |
| 4,714,143 | A * | 12/1987 | Saliba | 383/14 |
| 6,149,305 | A * | 11/2000 | Fier | 383/113 |
| 6,793,392 | B1 * | 9/2004 | Porret et al. | 383/61.1 |
| 2007/0119725 | A1 | 5/2007 | Rhodes | |

OTHER PUBLICATIONS

*3M Scotch-Weld® Hot Melt Adhesive 3798 LM Gummy Glue Removable Adhesive*, available at: http://products3.3m.com, downloaded Oct. 22, 2008.

* cited by examiner

*Primary Examiner* — Andrew Perreault
(74) *Attorney, Agent, or Firm* — Fay Sharpe LLP

(57) ABSTRACT

A package of sheet media and method of loading the package are presented in which a stack of sheet media is wrapped in a multi-layer strap, the multi-layer strap is operative to allow a user to load the package of sheet media into a media supply tray of an associated print engine, the multi-layer strap includes a third layer disposed between a first layer and a second layer, and the third layer is operative to allow the user to remove the multi-layer strap from the stack of sheet media while the stack of sheet media is positioned within the media supply tray.

25 Claims, 8 Drawing Sheets

SYSTEM AND METHOD FOR GREEN AND RAPID PAPER PACKAGING

BACKGROUND

The exemplary embodiment relates to the art of packaging and, more specifically, to packaged sheet media and a method of loading packaged sheet media into a printing system.

Loading of sheet media into a component of a printing system, such as a media supply tray, often presents the physical challenge of fitting the stack of sheet media into the tray. This challenge is further exacerbated when the users and/or operators of the printing system are disabled. For sheets of media to be correctly and consistently drawn into and fed along the media pathways of the printing system, it is desirable for the supply of sheet media to be captured within the tray or other supply component. This assists in maintaining a consistent orientation of the print media within the tray for uniform presentation of the sheets of media to the feeding mechanism. As such, the tray and/or component parts thereof are normally adjusted to closely fit around the sheet media stored therein. Unfortunately, this arrangement often makes the proper loading of a stack of sheet media into the tray a challenging task.

Due to the difficulties of loading an entire stack of media into the supply tray at one time, other techniques are attempted by users and/or operators of the printing system. For example, in one such technique a stack of sheet media is divided into smaller portions, which are then individually loaded into the supply tray. While these portions are usually somewhat more manageable to physically handle, the resulting load of sheet media will normally consist of multiple small portions that are often not uniformly stacked and may have considerable variability in orientation and/or presentation to the feeding mechanism. Moreover, manually removing smaller portions of sheet media from the package and placing them within the tray can lead to bent edges or damage to the sheets of paper. As a result, misfeeds, multifeeds and other conditions can occur and result in performance discontinuities.

In addition to misfeeds, multifeeds and other conditions that occur from the difficulties of loading sheet media into the media tray, valuable employee time is wasted. For example, traditional packages of sheet media are large cardboard boxes containing multiple, individually wrapped reams of sheet media (usually 500 sheets of sheet media per ream). In order to load a traditional package of sheet media into the supply tray, an employee must first open the exterior cardboard box, and thereafter unwrap and load the individual reams contained therein. Since media supply trays, namely high capacity feeders, include capacity for multiple reams, and perhaps multiple packages, of sheet media, loading the supply tray can take a significant amount of employee time. Similarly, other employees that rely upon a printing system must wait while the printing system is reloaded, thereby decreasing overall office productivity. Accordingly, it should be apparent that loading packages of sheet media wastes employee time and costs companies money.

Aside from issues of loading, traditional systems for packaging sheet media often produce a lot of waste, namely cardboard, that can present a significant cost of doing business in terms of landfill charges. Furthermore, in recent years, global warming has become increasingly more publicized and environmentally friendly technology has become more important. Traditional systems for packaging sheet media, however, have been slow to change with the times and still rely heavily upon cardboard, which generally has a higher carbon footprint than alternatives such as paper. Thus, systems for packaging sheet media that reduce the use of cardboard in favor of less carbon intensive alternatives present a more environmentally friendly packaging solution and reduce landfill charges.

The embodiments of packaged sheet media and method of using the same of the present disclosure are able to overcome these and other problems and disadvantages.

BRIEF DESCRIPTION

The present disclosure refers to a package of sheet media comprising a stack of individual sheets of sheet media and a multi-layer strap. The stack of sheet media includes a width, a height, and a length. The multi-layer strap has a first end and a second end. The multi-layer strap further includes a first layer, a second layer, and a third layer, where each layer includes a first end and a second end. The first end of the first layer and the first end of the second layer define the first end of the multi-layer strap. The third layer is disposed between the first layer and the second layer, and the second end of the third layer is connected to the second end of the first layer and the second end of the second layer. The multi-layer strap wraps around the stack of sheet media such that one end of the multi-layer strap overlaps the other end.

The present disclosure further refers to a method of loading a stack of sheet media into a media supply tray. The method includes providing a package of sheet media. The package of sheet media includes a stack of sheet media, a multi-layer strap which encircles the stack, a plurality of lifting handles, and a peeling handle. The multi-layer strap includes a first layer, a second layer, and a third layer. The method further includes raising the plurality of lifting handles and vertically aligning them; positioning the package of sheet media into the media supply tray using the plurality of lifting handles; exposing the peeling handle; and removing the multi-layer strap by pulling the peeling handle.

The present disclosure further refers to a package of sheet media comprising a stack of individual sheets of sheet media, a multi-layer strap, a plurality of lifting handles, and a peeling handle. The multi-layer strap encircles the stack and includes a first end overlapping a second end. The multi-layer strap further includes a first layer, a second layer and a third layer, where each of the layers includes a first end and a second end. The first end of the first layer and the first end of the second layer define the first end of the multi-layer strap. The third layer is disposed between the first layer and the second layer, and the second end of the third layer is connected to the second end of the first layer and the second end of the second layer. The plurality of lifting handles includes a first lifting handle, a second lifting handle, a third lifting handle and a fourth lifting handle. The first lifting handle is connected to the first end of the first layer of the multi-layer strap, and the second lifting handle is connected to the first end of the second layer of the multi-layer strap. The third lifting handle is defined by a loop formed by a connection of the second end of the first layer of the multi-layer strap with the second end of the third layer of the multi-layer strap. Similarly, the fourth lifting handle is defined by a loop formed by a connection of the second end of the second layer of the multi-layer strap with the second end of the third layer of the multi-layer strap. The peeling handle is connected to the first end of the third layer of the multi-layer strap and is disposed between the first layer of the multi-layer strap and the second layer of the multi-layer strap. The third lifting handle and the fourth lifting handle define the second end of the multi-layer strap.

In another aspect, a packaging assembly for packaging an associated item to be packaged is provided. The packaging assembly includes at least one elongate strip of sheet media folded to form a plurality of layers. The layers include first and second outer layers, each of the outer layers having a first lifting handle at a first end and a loop forming a second lifting handle at a second end and an inner third layer having a peeling handle at a first end and being joined to the loops adjacent a second end. A peelable adhesive joins the outer layers to the inner layer. The packaging assembly being of sufficient length to encircle the associated item to form an overlapping arrangement of handles which, when raised to a lifting orientation, allow the package to be carried by the handles, the packaging assembly being removable from the associated item by pulling on the peeling handle.

DETAILED DESCRIPTION

Figure 1:
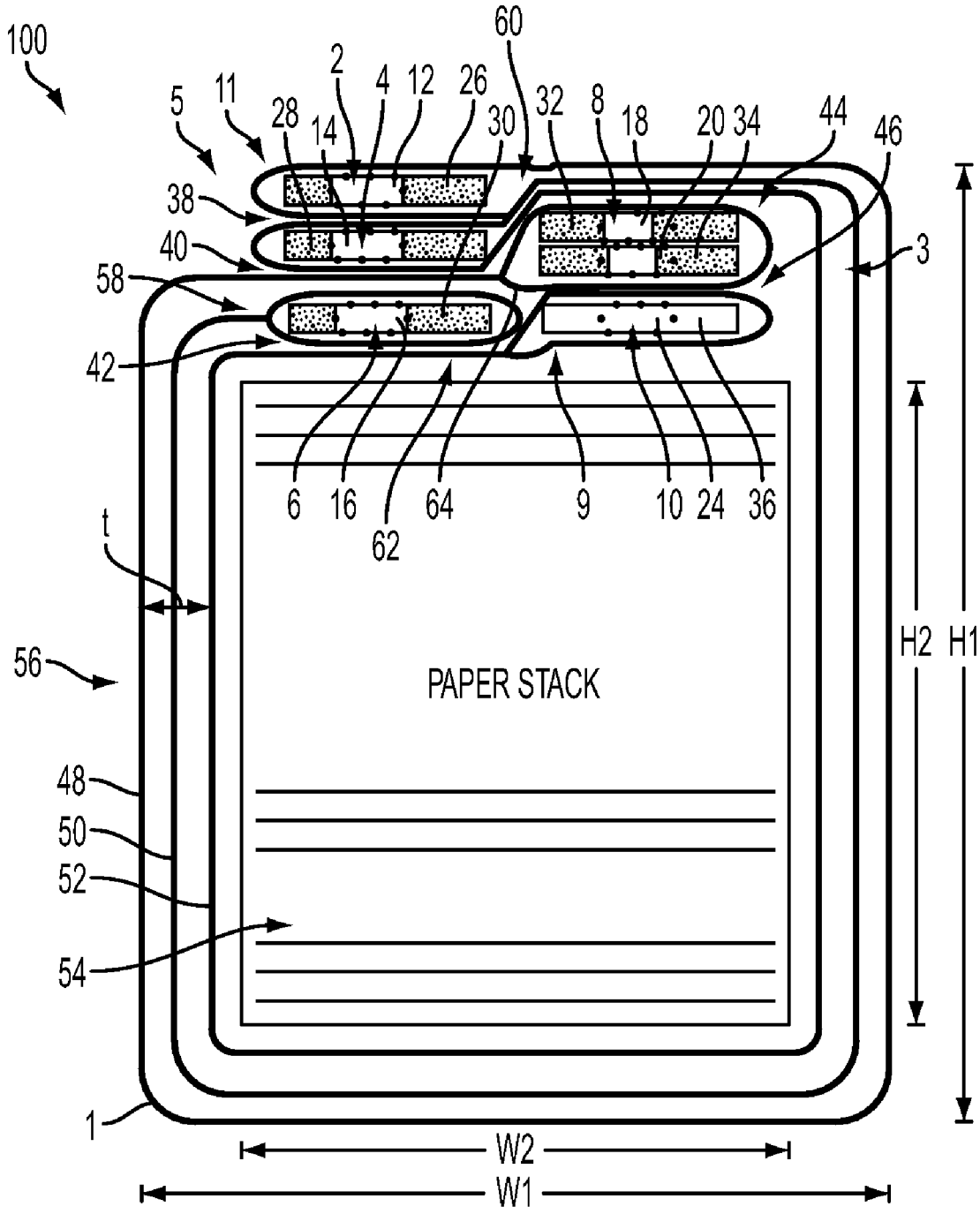
FIG. 1 is a cross sectional of a stack of sheet media packaged in accordance with an exemplary embodiment of the present disclosure.

Turning now to the drawing figures, several embodiments or implementations of the present disclosure are hereinafter described in conjunction with the drawings, wherein like reference numerals are used to refer to like components throughout, and wherein the various features and structures are not necessarily drawn to scale. The disclosure relates to a package of sheet media and a method of loading the package in which a stack of sheet media is wrapped in a multi-layer strap. The multi-layer strap is operative to allow a user to load the package of sheet media into a media supply tray of an associated print engine and includes a third layer disposed between a first layer and a second layer. The third layer is operative to allow the user to remove the multi-layer strap from the stack of sheet media while the stack of sheet media is positioned in the media supply tray.

The Terms "printer" and "printing system" as used herein are to be broadly interpreted to encompass any device, apparatus or system that is loaded or otherwise utilizes one or more stacks of sheet media and is capable of a "printing" action. Examples of such equipment and/or systems include, without limitation, desktop printers, network printers, standalone copiers, multi-function printer/copier/facsimile devices, and high-speed printing/publishing systems. Additionally, such sheet media can be of any type or kind, such as paper or polymeric film, for example. Furthermore, such exemplary embodiments of equipment and/or system can output indicia on the sheet media using any printing or marking substance, such as ink, toner or colorant, for example, in monochrome (e.g., black) or one or more colors, or any combination thereof.

FIG. 1 illustrates a package 100 of sheet media comprising a stack 54 of sheet media, and a packaging assembly 1, which includes a multi-layer strap 56, a plurality of lifting handles 2, 4, 8, 10 and a peeling handle 6. In a storage orientation shown in FIG. 1, the handles are all horizontally arranged and parallel to each other. The package 100 has a width W1, a height H1, and a length L1 (shown in FIG. 2), and is predominantly formed of paper. The multi-layer strap 56 wraps around the stack 54 of sheet media and allows the user to load the entire stack 54 into a media supply tray 78 (shown in FIG. 3). The plurality of lifting handles 2, 4, 8, 10 and the peeling handle 6 operate in conjunction with the multi-layer strap 56 to allow the user to position the stack of sheet media 54 into the media supply tray 78 and remove the multi-layer strap 56 from around the stack 54.

Referring to FIG. 1, the stack of sheet media 54 has a width W2, a height H2 and a length (not shown) in the direction of the length L1 of the package 100. It should be appreciated that the dimensions of the stack 54 are substantially the same as the dimensions of the package 100. The stack 54 is formed from a plurality of individual sheets of sheet media having substantially the same dimensions as the stack length and the stack width W2. The stack width W2 may be less than or equal to the stack length such that, for example, a stack 54 made of individual sheets of 210 mm×297 mm paper is defined by a stack width W2 of 210 mm and a stack length of 297 mm. The sheet media may be formed from any number of materials including, but not limited to, paper, polymeric materials, and cardboard. It will further be appreciated that the height H2 of the stack 54 is attributed to the number of sheets of sheet media forming the stack 54 and the corresponding thickness of the individual sheets of sheet media. The thickness of individual sheets of sheet media is substantially uniform from sheet to sheet. The stack 54 may include any suitable number of sheets of sheet media. For example, the stack 54 may include at least 500 sheets and in one embodiment 1,000 sheets or 2,500 sheets.

The multi-layer strap 56 includes a first layer 48, a second layer 52, and a third layer 50. Each layer 48, 50, 52 includes a first end and an opposite, second end. The multi-layer strap 56 wraps around the stack of sheet media 54, and may be centrally located along one of the stack width W2 and the stack length. FIG. 1 illustrates an embodiment where the multi-layer strap 56 is centered along the stack length. The second ends of the plurality of layers 48, 50, 52 connect at a common region 60 such that the second end of the third layer 50 connects to the second end of the first layer 48 and the second end of the second layer 52. The common region 60 may be formed from an adhesive material, such as glue, epoxy or the like. The multi-layer strap 56 further includes a first end 9 and a second, opposite end 11. The first end 9 of the multi-layer strap 56 is defined by a first end 64 of the first layer 48 and a first end 62 of the second layer 52.

Figure 2:
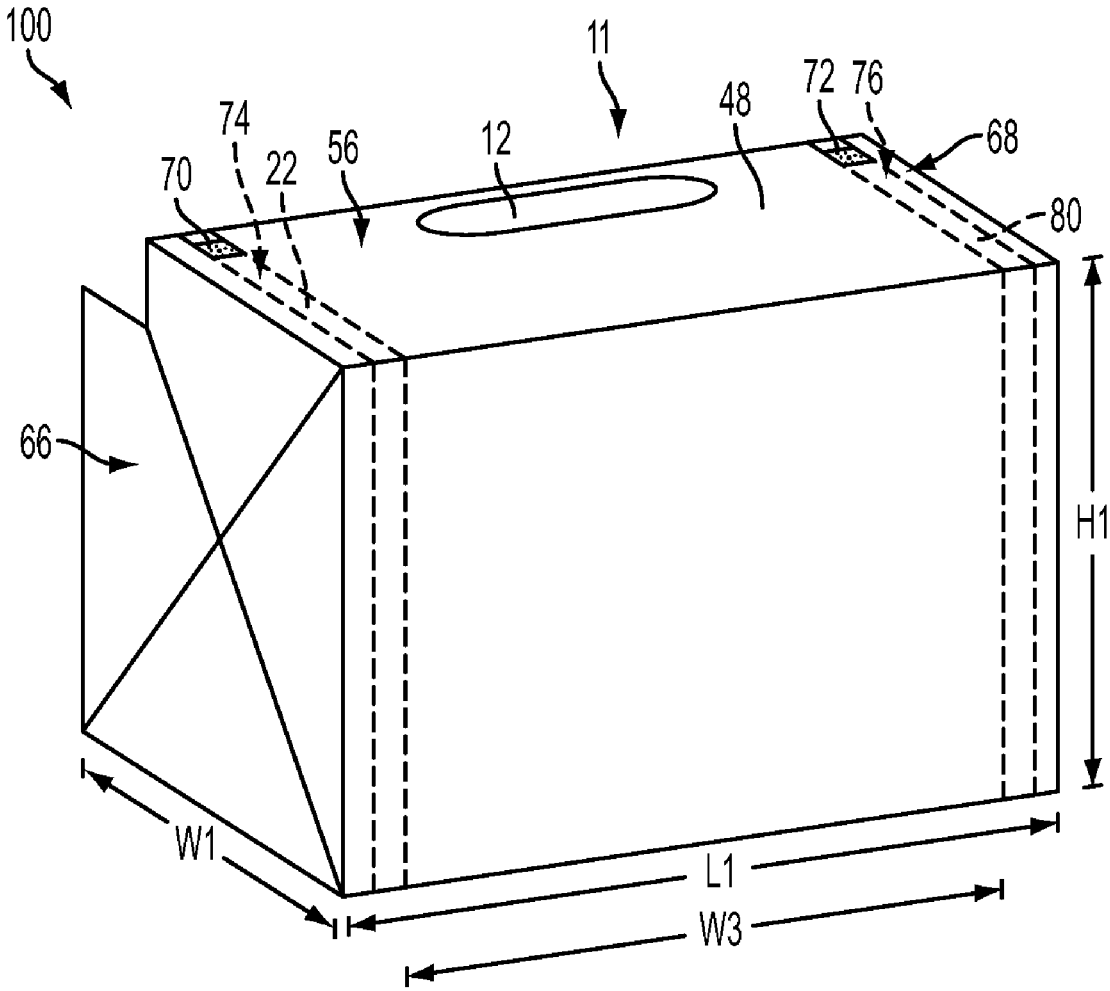
FIG. 2 is a perspective view of the stack of sheet media in FIG. 1.

The multi-layer strap 56 has a width W3 (shown in FIG. 2), a thickness t and a length which extends from the first end 9 of the strap 56 to the second end 11. The thickness t of the multi-layer strap 56 is the summation of thicknesses of the plurality of layers 48, 50, 52. The length of the multi-layer strap 56 is at least twice the stack height H2 plus twice either the stack width W2 or the stack length, depending upon how the strap is centered along the stack of sheet media 54. As illustrated in FIG. 1, the length of the multi-layer strap 56 is at least a length of twice the stack height H2 plus twice the stack width W2 because the multi-layer strap is centered along the stack length. The second layer 52 of the multi-layer strap 56 and the first layer 48 of the multi-layer strap 56 are at least the length of the multi-layer strap 56. Additionally, the length of the third layer 50 of the multi-layer strap 56 is at most the length of the multi-layer strap 56. The width W3 of the multi-layer strap 56 is at most either the stack width W2 or the stack length, depending upon how the multi-layer strap 56 is oriented on the stack 54. As illustrated in FIG. 2, the width W3 of the multi-layer strap 56 is somewhat less than the length of the stack 54 because the multi-layer strap is centered along the stack length. The width W3 of the multi-layer strap 56 should also be at least wide enough to support the stack 54, and ensure stability when carrying and positioning the stack 54 within the media supply tray 78.

The plurality of lifting handles 2, 4, 8, 10 include a first lifting handle 8 and a second lifting handle 10. As illustrated in FIG. 1, the first lifting handle 8 is connected to the first end 64 of the first layer 48 of the multi-layer strap 56, and the second lifting handle 10 is connected to the first end 62 of the second layer 52 of the multi-layer strap 56. Likewise, the peeling handle 6 is connected to a first end 58 of the third layer 50 of the multi-layer strap 56. Similar to the common region 60 discussed above, the first lifting handle 8, the second lifting handle 10, and the peeling handle 6 may be each connected to their respective layers 48, 52, 50 by an adhesive material, such as glue, epoxy or the like. The first lifting handle 8, the second lifting handle 10 and the peeling handle 6 may each include loops capable of accepting stiffening inserts. As shown in FIG. 1, the loops of the first lifting handle 8, the second lifting handle 10 and the peeling handle 6 are formed from the same piece of material that forms their respective layers by folding the material layer on itself at the end.

The plurality of lifting handles 2, 4, 8, 10 further includes a third lifting handle 2 and a fourth lifting handle 4. The third lifting handle 2 is formed by the second end of the first layer 48 looping inward and connecting to the second end of the third layer 50 to form a loop. Likewise, the fourth lifting handle 4 is formed by the second end of the second layer 52 looping inward and connecting to the second end of the third layer 50 to form a loop. The third lifting handle 2 and the fourth lifting handle 4 define the second end 11 of the multi-layer strap 56. Additionally, the loops of the third and fourth lifting handles 2, 4 are operative to accept stiffening inserts 2, 4. In the exemplary embodiment, as illustrated in FIG. 1, the first lifting handle 8 includes two stiffening inserts 32, 34, one on top of the other, although a single insert may alternatively be used. The second lifting handle 10 includes a stiffening insert 36, the third lifting handle 2 includes a stiffening insert 26, the fourth lifting handle 4 includes a stiffening insert 28, and the peeling handle 6 includes a stiffening insert 30. The stiffening inserts may have a width (not shown) of at most the width W3 of the multi-layer strap 56 and are made of cardboard. However, materials other than cardboard may be used such as, but not limited to, polymeric materials and paper. In general the stiffening inserts are more rigid than the respective layers of the strap.

The plurality of lifting handles 2, 4, 8, 10 and the peeling handle 6 include through-cuts 12, 14, 16, 18, 20, 24 so an operator can insert the fingers of one hand through the handles 2, 4, 8, 10, 6. However, some of the handles are covered prior to use. The through-cuts 12, 14, 16, 18, 20, 24 of the plurality of lifting handles 2, 4, 8, 10 and the peeling handle 6 may be centrally located on the respective handles 2, 4, 8, 10, 6. As illustrated in FIG. 1, the peeling handle 6 includes a through-cut 16, the first lifting handle 8 includes through-cuts 18, 20, the second lifting handle 10 includes through-cut 24, the third lifting handle 2 includes through-cut 12 and the fourth-lifting handle 4 includes through-cut 14. In the exemplary embodiment, the third lifting handle 2, the fourth lifting handle 4 and the peeling handle 6 are horizontally aligned such that their respective through-cuts 12, 14, 16 overlap. Similarly, the first lifting handle 8 and the second lifting handle 10 are horizontally aligned such that their respective through-cuts 18, 20, 24 overlap. It should be appreciated that the peeling handle 6 is disposed between the inner layer 52 of the multi-layer strap 56 and the outer layer 48 of the multi-layer strap 56.

The first lifting handle 8 and the second lifting handle 10 form a first lifting group 3, and the third lifting handle 2 and the fourth lifting handle 4 form a second lifting group 5. The first lifting group 3 and the second lifting group 5 overlap such that only the second lifting group 5 remains externally visible because the multi-layer strap 56 covers the first lifting group 3. The stiffening inserts have thicknesses, and the sum of the thicknesses of the stiffening inserts 12, 14, 16 used in the third lifting handle 2, the fourth lifting handle 4 and the peeling handle 6 may be substantially the same as the sum of the thicknesses of the stiffening inserts 18, 20, 24 used in the first lifting handle 8 and the second lifting handle 10.

The fourth lifting handle 4 and the third lifting handle 2 may be adhered to one another via a peelable adhesive layer 38. Likewise, the first lifting handle 8 and the second lifting handle 10 may be adhered to one another via a peelable adhesive layer 46. The second lifting group 5 may be adhered to the first layer 48 via a peelable adhesive layer 40, and the first lifting group 3 may be adhered to the second layer 52 via a peelable adhesive layer 44. The peeling handle 6 may be adhered to the second layer 52 via a peelable adhesive layer 42. The peelable adhesive layers 38, 40, 42, 44, 46 are operative to maintain structural integrity of the package 100, while at the same time allowing the user to easily unpack the package of sheet media 100. By "peelable," it is meant that that the adhesive provides a frangible join which allows the respective paper layers to be separated without appreciably damaging them. In one embodiment, the peelable adhesive layers 38, 40, 42, 44, 46 are formed from peelable glue, but it should be appreciated that the peelable adhesive layers 38, 40, 42, 44, 46 may be formed from any suitable adhesives, including, but not limited to, adhesives such as butyl rubber, epoxies, meth (acrylate), silane polymers, and the like. The adhesive may be a pressure sensitive adhesive, heat cured adhesive, low temperature melt adhesive, or the like. Adhesives sold as "fugitive adhesives", are suitable examples. Gummy Glue Removable Adhesive, a low melt temperature adhesive available from 3M, which can be applied with a glue gun is an example of such an adhesive.

Turning to FIG. 2, a second embodiment of packaging assembly 1 is shown in perspective view, which may be similarly configured to that of FIG. 1, except as noted. The multi-layer strap 56 divides the stack of sheet media 54 into a first region, a second region and a third region, where the third region is disposed between the first region and the second region. The first region is defined by an exposed first end of the stack of sheet media 56, and the second region is defined by an opposite, exposed end of the stack of sheet media 56. Thus, one should appreciate that the exposed ends are the parts of the stack not covered by the multi-layer strap 56. The first region is covered by the first cover 66, the second region is covered by the second cover 68, and the third region is covered by the multi-layer strap 56. The size of the covers 66, 68 is dependent upon the dimensions of the stack 54 and the width W3 of the multi-layer strap 56. The first cover 66 and the second cover 68 may be formed from paper ears folded inward as shown in FIG. 2. However, paper ears need not necessarily be used, and the first cover 66 and the second cover 68 may be formed in any way that is functionally equivalent. In one embodiment the multi-layer strap 56 and/or the first cover 66 and the second cover 68 are formed of paper.

The first cover 66 and the second cover 68 are further connected to the multi-layer strap 56 such that the first cover 66 and the second cover 68 are removable from the multi-layer strap 56. Although the connection of the first cover 66 and the second cover 68 to the multi-layer strap 56 may be achieved by any number of methods, one exemplary method is via tear strips 74, 76 that extend around the package of sheet media 100. As illustrated in FIG. 2, the first cover 66 and the second cover 68 are connected to the multi-layer strap 56 via a first tear strip 74 and a second tear strip 76, respectively. The first tear strip 74 includes a pull tab 70 and a perforated track 22, and the second pull strip 76 includes a pull tab 72 and a perforated track 80. The tear strips 74, 76 run parallel to the multi-layer strap 56 at the boundaries between the multi-layer strap 56 and the covers 66, 68. Removal of the first cover 66 is achieved via the first pull strip 74, wherein the user pulls the pull tab 70 of the first tear strip 74 along the first perforated track 22. Likewise, removal of the second cover 68 is achieved via the second pull strip 76, wherein the user pulls the pull tab 72 of the second tear strip 72 along the second perforated track 80.

Figure 3:
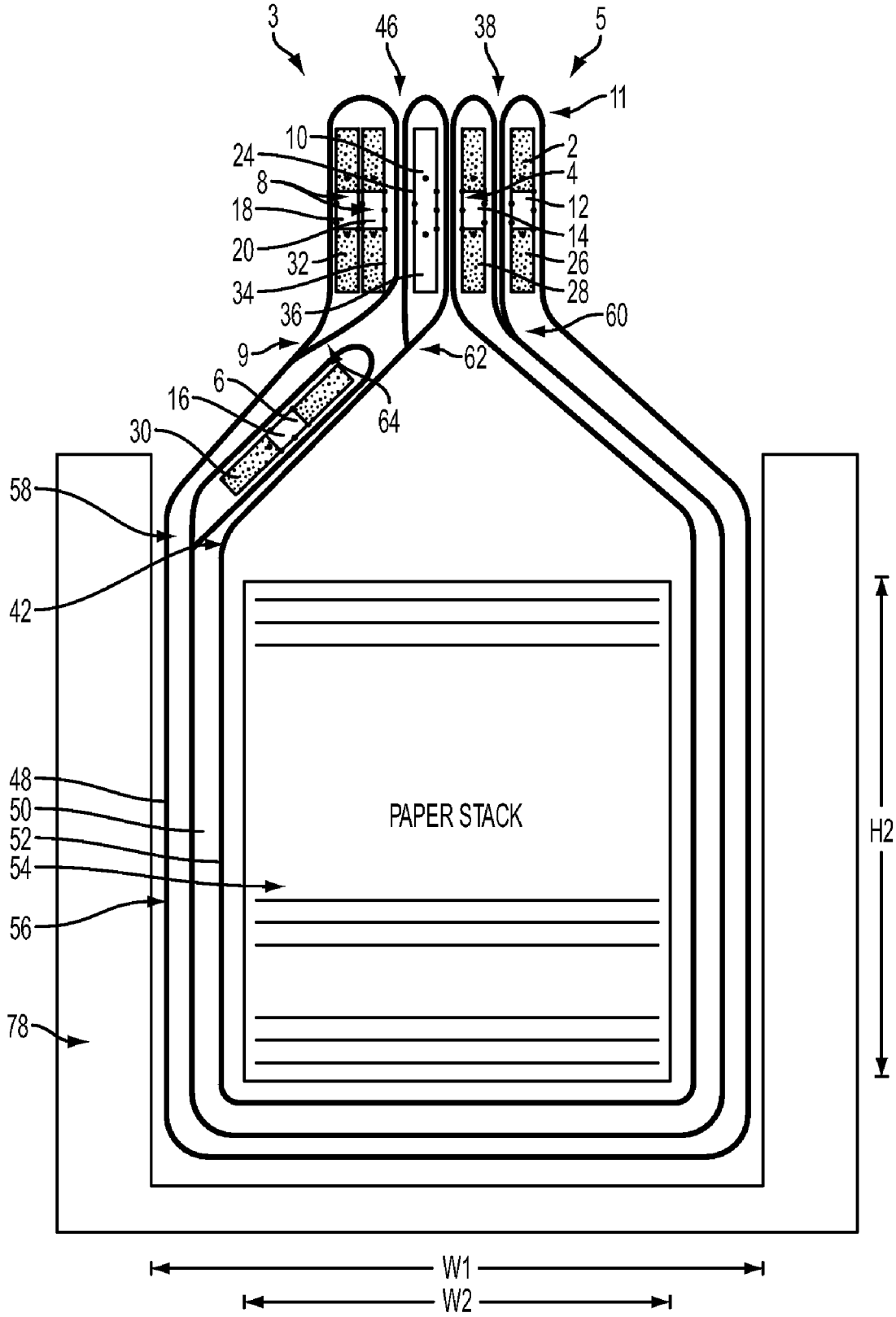
FIG. 3 is a cross sectional view of the packaged stack of sheet media in FIG. 1 loaded into an associated media supply tray of a printing system.

FIG. 3 shows an end view of the package of sheet media 100 in FIG. 1 loaded into an associated media supply tray 78 of a printing system (not shown). The handles 2, 4, 6, 8, 10 are in a lifting orientation. Prior to loading, the covers 66, 68 are removed and the lifting handles 2, 4, 8, 10 are vertically aligned, as shown, by peeling the lifting handles 2, 4, 8, 10 at the peelable adhesives 40 and 44. The media supply tray 78 may be a high capacity feeder capable of handling at least 2,500 sheets of sheet media. The first lifting group 3 and the second lifting group 5 are shown vertically aligned such the user is able to simultaneously insert their fingers through both the through-cuts 12, 14 of the second lifting group 5 and the through-cuts 18, 20, 24 of the first lifting group 3.

Figure 4:
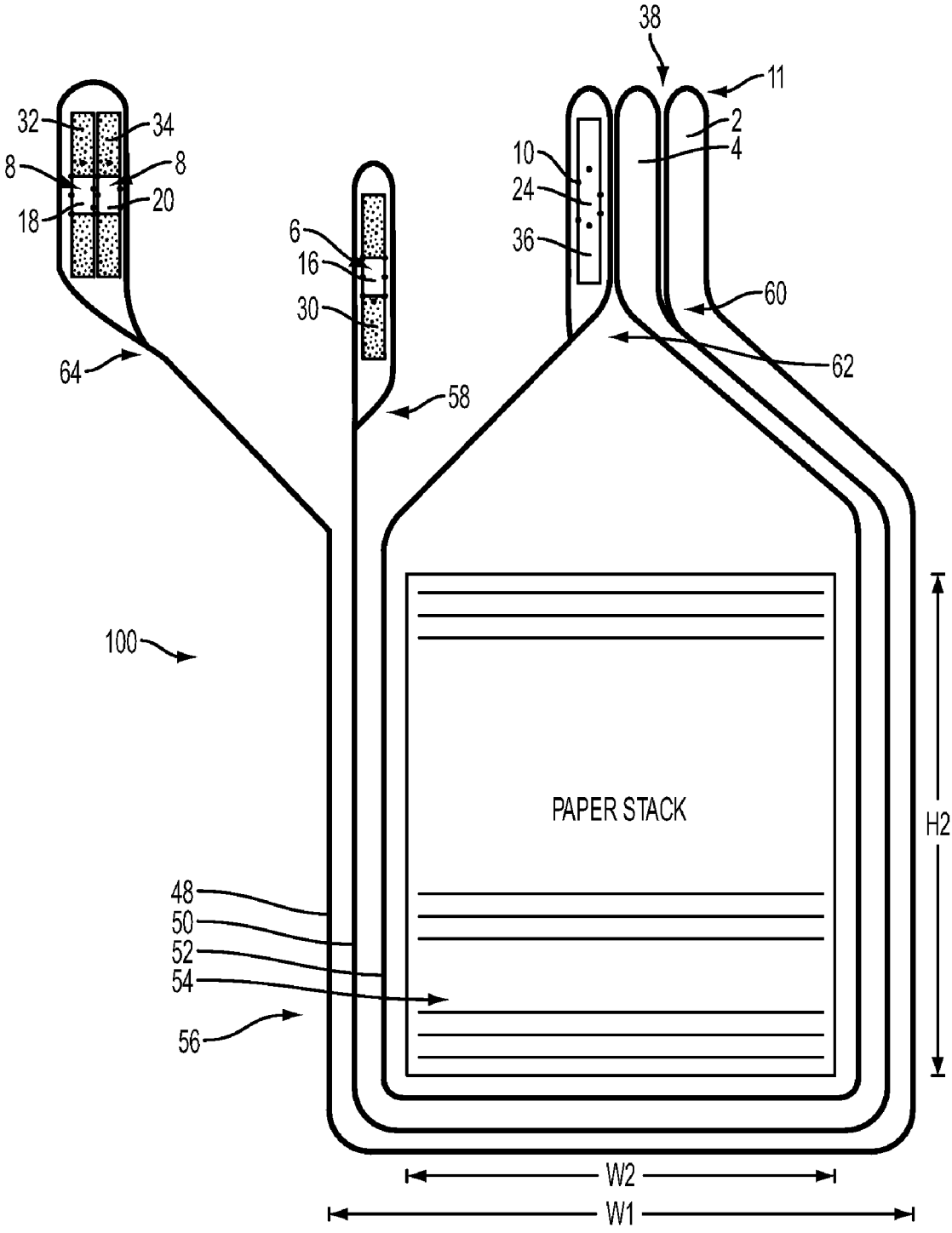
FIG. 4 is a cross sectional view of the packaged stack of sheet media in FIG. 1 where the packaging is prepared for removal from the stack of sheet media.

FIG. 4 is an end view of the packaged stack of sheet media 100 in FIG. 1 where the packaging is prepared for removal from the stack of sheet media 54. The first lifting handle 8 includes the stiffening inserts 32 and 34, the second lifting handle 10 includes the stiffening insert 36, and the peeling handle 6 includes the stiffening insert 30. The third lifting handle 2 and the fourth lifting handle 4 no longer include their stiffening inserts so the multi-layer strap 56 may be easily removed. The first lifting handle 8 and the second lifting handle 10 are spread, and the peeling handle 6 is peeled up from the peelable adhesion layer 42. While the package 100 is not shown in the media supply tray 78, as in FIG. 3, it should be appreciated that the packaged stack of FIG. 4 can be within the media supply tray 78.

Figure 5:
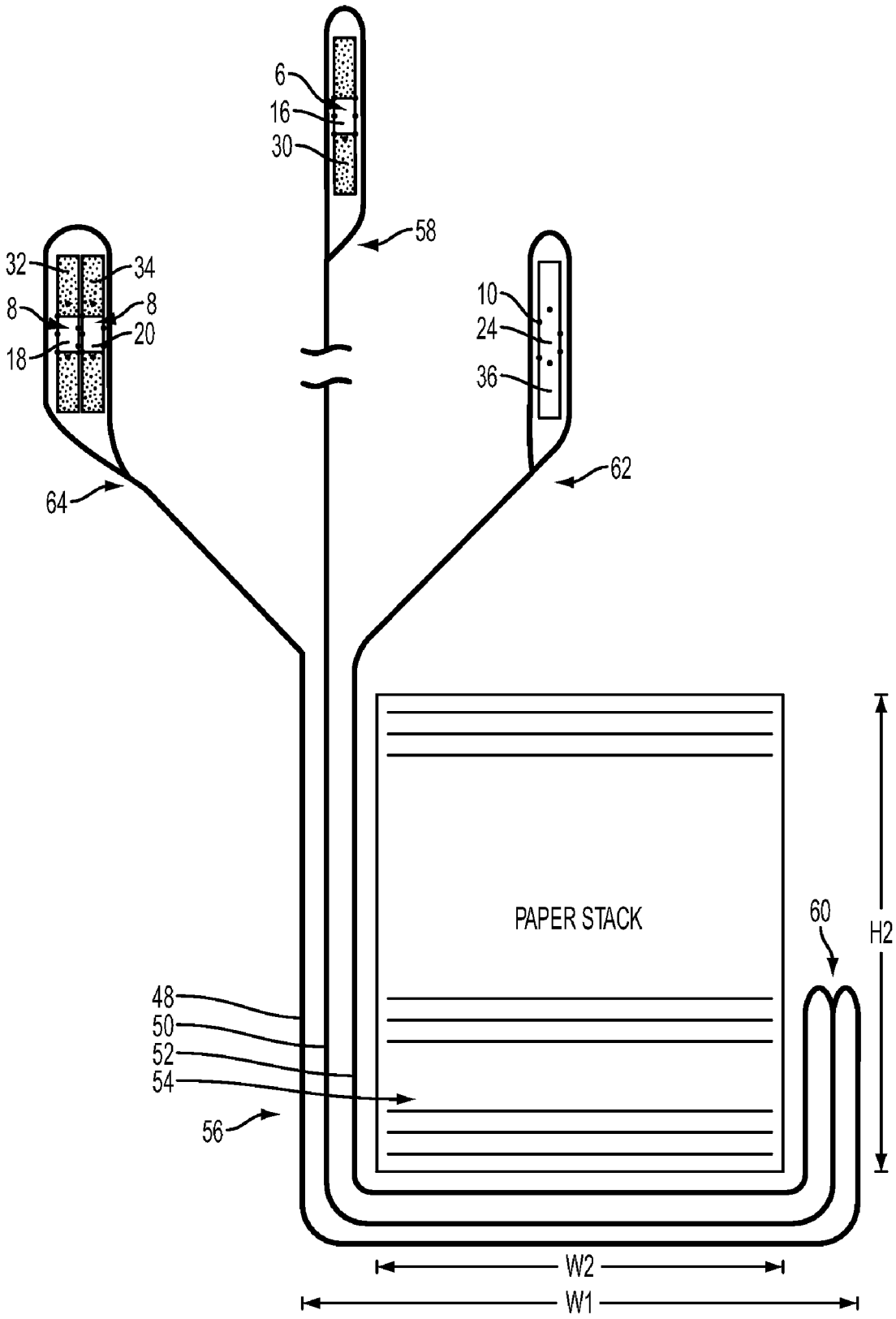
FIG. 5 is a cross sectional view of the packaged stack of sheet media in FIG. 1 where the packaging is partially removed from the stack of sheet media.

FIG. 5 is an end view of the packaged stack of sheet media 100 of FIG. 1, where the packaging is partially removed from the stack of sheet media 54 and the peeling handle 6 is pulled up. Pulling the peeling handle 6 up pulls the third layer 50 of the multi-layer strap 56. Since the second end of the first layer 48 of the multi-layer strap 56 and the second end of the second layer 52 of the multi-layer strap 56 are attached to the second end of the third layer 50 of the multi-layer strap 56, as an operator pulls the first end 58 of third layer 50 with the peeling handle 6, the second layer 52 of the multi-layer strap 56 and the first layer 48 of the multi-layer strap 56 are pulled inward upon themselves. It should be appreciated that during this action, the outsides of the first layer 48 and the second layer 52 are pulled into the gap between them. While the package 100 is not shown in the media supply tray 78, as in FIG. 3, it should be appreciated that the packaged stack of FIG. 5 can be within the media supply tray 78.

Figure 6:
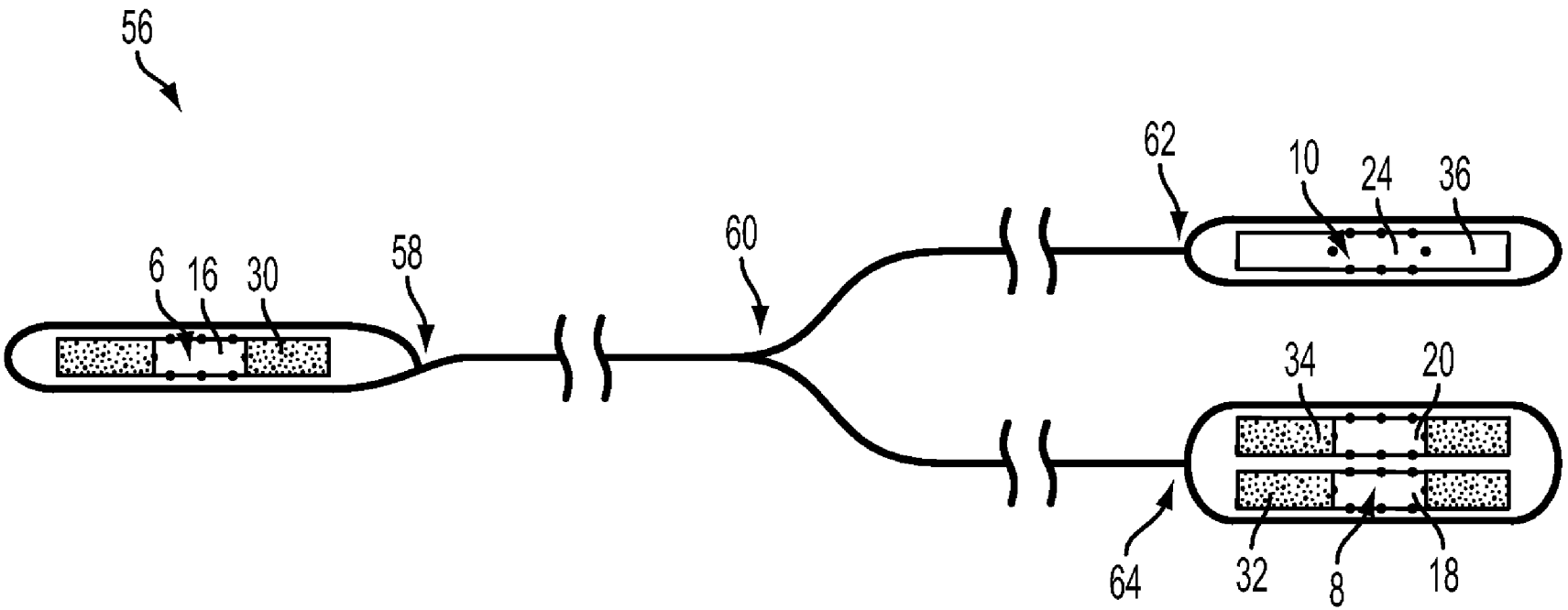
FIG. 6 is an end view of the packaging assembly of FIG. 1 removed from around the stack of sheet media.

FIG. 6 depicts an end view of the packaging of FIG. 1 removed from around the stack of sheet media 54. Attached to the multi-layer strap 56 are the first lifting handle 8, the second lifting handle 10, and the peeling handle 6. The first lifting handle 8 includes the stiffening inserts 32 and 34, the second lifting handle 10 includes the stiffening insert 36, and the peeling handle 6 includes the stiffening insert 30. As previously noted, the exemplary multi-layer strap 56 can be made of paper, and the stiffening inserts 30, 36, 32, 34 can be made of cardboard.

Figure 7:
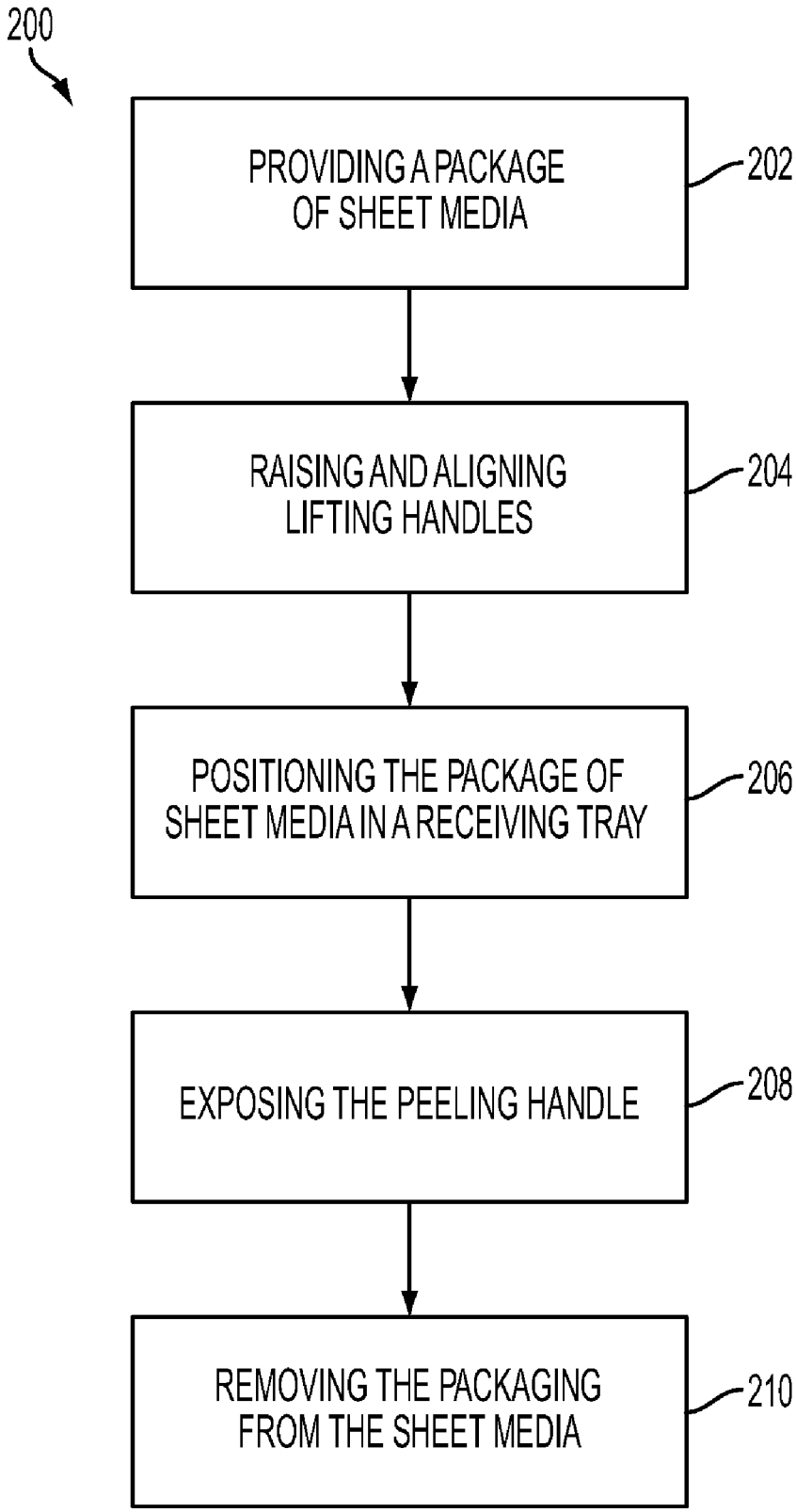
FIG. 7 is a flowchart of one exemplary embodiment of a method of unwrapping the packaged stack in accordance with the present disclosure.

The present disclosure, as shown in FIG. 7, further refers to a method 200 of loading a stack of sheet media 54 into a media supply tray 78 of a printing system. The method 200 includes providing 202 the package of sheet media 100 discussed above, raising 204 the plurality of lifting handles 2, 4, 8, 10 and vertically aligning them, positioning 206 the package of sheet media 100 into the media supply tray 78 using the plurality of lifting handles 2, 4, 8, 10, exposing 208 the peeling handle 6, and removing 210 the multi-layer strap 56 by pulling on the peeling handle 6. In an exemplary embodiment, the method 200 further includes removing the first cover 66 and the second cover 68 before positioning the package of sheet media 100 into the media supply tray 78. This may include pulling the pull tabs 70, 72, above described, along the perforated tracks of 22, 80 of the tear strips 74, 76 that extend around the stack of sheet media 54. The method 200 may further include disposing the stiffening inserts 12, 14, 16, 18, 20, 24, the covers 66, 68, and the multi-layer strap 56. The exemplary multi-layer strap 56, the covers 66, 68, and the stiffening inserts 12, 14, 16, 18, 20, 24 can be disposed of by recycling.

Raising 204 the plurality of lifting handles 2, 4, 8, 10 and vertically aligning them includes first peeling the second lifting group 5 from the multi-layer strap 56, and, thereafter, pulling the first and second lifting groups 3, 5 upward and connecting them as shown in FIG. 3. As discussed above, the second lifting group 5 is connected to the multi-layer strap 56 via the peelable adhesive layer 40 and the first lifting group 3 is connected to the multi-layer strap 56 via the peelable adhesive layer 44. After raising the handles to the vertical position as shown in FIG. 3, a user is able to place their fingers through the through-cuts 12, 14, 18, 20, 24 of the connected lifting groups 3, 5. The connected lifting groups 3, 5 are used in positioning 206 the stack of sheet media 54 into the media tray 78. FIG. 3 shows the stack of sheet media 54 positioned into the media supply tray 78.

Exposing 208 the peeling handle 6 may take place after the stack of sheet media 54 has been lifted into the media supply tray 78. Exposing 208 includes peeling apart the first lifting handle 8 from the second lifting handle 10 at the peelable adhesive layer 46 to expose the peeling handle 6. Removing 210 the multi-layer strap 56 from around the stack of sheet media 54 includes removing the stiffening inserts 32, 34, 36 in the third lifting handle 2 and the fourth lifting handle 4. Additionally, removing 210 the multi-layer strap 56 includes peeling up the peeling handle 6 from the peelable adhesion layer 42, and pulling up on the peeling handle 6 until the multi-layer strap 56 is completely removed. The illustrated peeling handle 6 includes a through-cut 16 similar to the through-cuts 12, 14, 18, 20, 24 of the plurality of lifting handles 2, 4, 8, 10 so that a user may insert their fingers through the peeling handle 6. As illustrated in FIG. 5, the multi-layer strap 56 has been partially removed and the peeling handle 6 has been pulled up part of the distance required for complete removal of the multi-layer strap 56. FIG. 6 displays a fully removed multi-layer strap 56 after the user has fully pulled the peeling handle 6.

Figure 8:
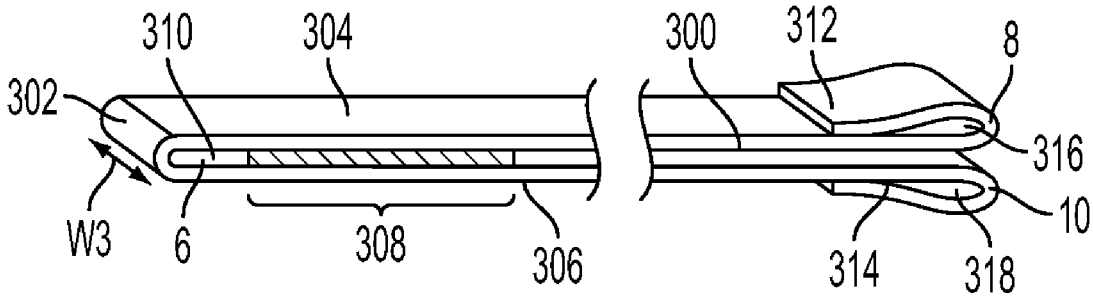
FIGS. 8 and 9 illustrate a method of forming the packaging assembly and packaged item.
Figure 9:
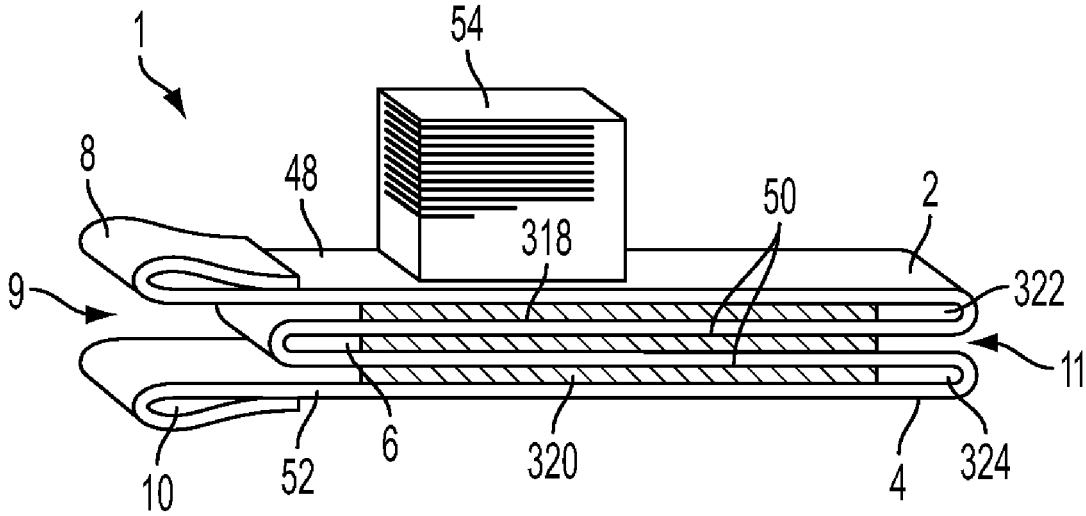

FIGS. 8 and 9 illustrate a method for preparing the packaging assembly 1 for packaging an item such as stack 54. In one embodiment, the packaging assembly 1 may be formed of a single elongate sheet 300 of paper or card (or several plies of paper joined together). Sheet 300 may have a length which is approximately four times the circumference of the item 54 and a width at least equal to W3 (longer if it is to include the covers 66, 68. The sheet 300 is folded over at around a midpoint 302, and the two adjacent layers 304, 306 adhesively or otherwise attached in a region 308 to form the peeling layer and a slot 310 to form the peeling handle 6. The two ends 312, 314 of the sheet opposite the peeling handle are folded over and adhesively or otherwise attached to the respective layer 304, 306 to leave a respective slot 316, 318, to form the handles 8, 10. The two ends 312, 316, are then drawn over the peeling handle on respective sides as shown in FIG. 9, and adhesively attached to the peeling layer in respective regions 318, 320 with peelable adhesive leaving a small slot 322, 324 at the ends for defining handles 2, 4. The packaging assembly 1 can be stored in this configuration until it is time to wrap a stack of sheets. At that time, the packaging assembly is wrapped around the stack such the handles 2, 4 overlay handles 8, 10 midpoint of the assembly. An insert can be placed in each of the loops and handles to provide extra rigidity for lifting the package. Peelable adhesive is used in the overlap region 60 where the handles overlie each other to join the first end 9 of the strap to the second end 11 to hold the assembly on the item. In the case where covers 66, 68 are integral with the assembly 1, these can be formed by folding the side edges of the packaging assembly around the sides of the stack and sealed with adhesive to form the covers as shown in FIG. 2. Additional peeleable adhesive may then be used in the overlap region 60.

As will be appreciated, instead of being formed of two layers or plies sandwiched together, the intermediate layer 50 may alternatively be formed instead of a single ply and loops 2 and 4 formed by adhesive attachment of the outer layers 48, 52 to the single ply adjacent the second end 11.

It will be appreciated that various of the above-disclosed and other features and functions, or alternatives thereof, may be desirably combined into many other different systems or applications, and further that various presently unforeseen or unanticipated alternatives, modifications, variations or improvements therein may be subsequently made by those skilled in the art which are also intended to be encompassed by the following claims.

The invention claimed is:

1. A package of sheet media comprising:

a stack of individual sheets of sheet media, said stack including a stack width, a stack height and a stack length;

a multi-layer strap with a first end and a second end, said multi-layer strap including:

a first layer with a first end and a second end, said first layer encircling said stack, a second layer with a first end and a second end, said first end of said first layer and said first end of said second layer defining said first end of said multi-layer strap, said second layer encircling said stack, a third layer with a first end and a second end, said third layer disposed intermediate said first layer and said second layer, and said second end of said third layer connected to said second end of said first layer and said second end of said second layer, and a peeling handle at said first end of said third layer of said multi-layer strap, the peeling handle being disposed between the first layer and second layer, the strap being removable from the stack by pulling on the peeling handle, whereby when the third layer is pulled with the peeling handle, the second layer of the multi-layer strap and the first layer of the multi-layer strap are pulled inward upon themselves to release the stack; and said multi-layer strap being wrapped around said stack such that one of said first end of said multi-layer strap and said second end of said multi-layer strap is overlapping the other of said first end and said second end of said multi-layer strap.

2. A package of sheet media according to claim 1, wherein said stack of sheet media includes at least 500 sheets of sheet media.

3. A package of sheet media according to claim 1, wherein said multi-layer strap has a width which is centrally located along a one of said stack width and said stack length.

4. A package of sheet media according to claim 1, wherein said multi-layer strap is predominantly formed of paper.

5. A package of sheet media according to claim 1, wherein said multi-layer strap divides said stack of sheet media into a first region, a second region and a third region, said third region disposed between said first region and said second region, said first region covered by a first cover, said second region covered by a second cover, and said third region covered by said multi-layer strap.

6. A package of sheet media according to claim 5, wherein at least one of said first cover and said second cover is formed of paper.

7. A package of sheet media according to claim 5, wherein said first cover and said second cover are removably connected to said multi-layer strap.

8. A package of sheet media according to claim 7, wherein said first cover and said second cover are connected to said multi-layer strap via tear strips.

9. A package of sheet media according to claim 1, further comprising:

a first lifting handle connected to said first end of said first layer of said multi-layer strap;

a second lifting handle connected to said first end of said second layer of said multi-layer strap.

10. A package of sheet media according to claim 9, further comprising:

a third lifting handle defined by a loop formed between said second end of said first layer of said multi-layer strap and said second end of said third layer of said multi-layer strap;

a fourth lifting handle defined by a loop formed between said second end of said second layer of said multi-layer strap and said second end of said third layer of said multi-layer strap;

said second end of said multi-layer strap defined by said third lifting handle and said fourth lifting handle.

11. A package of sheet media according to claim 10, wherein said one end of the strap is adhesively attached to the other end of the strap adjacent the lifting handles.

12. A package of sheet media according to claim 10, wherein said third lifting handle, said fourth lifting handle, and said peeling handle are aligned with each other.

13. A package of sheet media according to claim 11, wherein said first lifting handle and said second lifting handle are aligned with each other.

14. A package of sheet media according to claim 10, wherein at least one of said first lifting handle, second lifting handle, third lifting handle, fourth lifting handle and said peeling handle includes a stiffening insert with a cutout.

15. A package of sheet media according to claim 14, wherein said at least one stiffening insert is formed from cardboard.

16. A package of sheet media according to claim 14, wherein said third lifting handle and said fourth lifting handle include removable stiffening inserts.

17. A method of loading a stack of sheet media into a media supply tray comprising:

providing the package of sheet media of claim 9;

raising said lifting handles and vertically aligning them;

positioning said package of sheet media in said media supply tray using said plurality of lifting handles; and removing said multi-layer strap by pulling said peeling handle.

18. The method according to claim 17, wherein said plurality of lifting handles include a first lifting handle, a second lifting handle, a third lifting handle and a fourth lifting handle, said first, second, third, and fourth lifting handles and said peeling handle each including at least one stiffening insert, said method further comprising:

removing said stiffening inserts from said third lifting handle and said fourth lifting handles prior to removal of said multi-layer strap.

19. A package of sheet media according to claim 1, further comprising:

first, second, third and fourth lifting handles which are vertically alignable for lifting the package, the first lifting handle being connected to said first end of said first layer of said multi-layer strap;

the second lifting handle being connected to said first end of said second layer of said multi-layer strap;

the third lifting handle being defined by a loop formed by a connection of said second end of said first layer of said multi-layer strap with said second end of said third layer of said multi-layer strap;

the fourth lifting handle being defined by a loop formed by a connection of said second end of said second layer of said multi-layer strap with said second end of said third layer of said multi-layer strap; and, said third lifting handle and said fourth lifting handle defining said second end of said multi-layer strap.

20. A package of sheet media according to claim 1, further comprising:

a peelable adhesive joining the first and second layers to the third layer.

21. A package of sheet media according to claim 1, wherein said second end of said first layer, said second end of said second layer are attached to said second end of said third layer.

22. A packaging assembly for packaging an associated item to be packaged, comprising:

a multilayer strap comprising at least one elongate strip of sheet media, the at least one strip being folded to form three layers, the layers including:

a first layer with a first end and a second end, a second layer with a first end and a second end, said first end of said first layer and said first end of said second layer defining said first end of said multi-layer strap, and a third layer with a first end and a second end, said third layer disposed intermediate said first layer and said second layer, and said second end of said third layer connected to said second end of said first layer and said second end of said second layer, said first end of said third layer defining a peeling handle, the peeling handle being disposed between the first layer and the second layer; and said multi-layer strap being wrappable around said item such that one of said first end of said multi-layer strap and said second end of said multi-layer strap is overlapping the other of said first end and said second end of said multi-layer strap, whereby pulling the peeling handle pulls the first end of the third layer, pulling the first layer and second layer inward upon themselves.

23. A package of sheet media according to claim 22, wherein said multilayer strip is predominantly formed from paper.

24. A package of sheet media comprising:

a stack of individual sheets of sheet media, said stack including a stack width, a stack height and a stack length;

a multi-layer strap with a first end and a second end, said multi-layer strap including:

a first lifting handle at the first end of the multilayer strap;

a second lifting handle at the second end of the multi-layer strap;

a third lifting handle at the first end of the multilayer strap;

a fourth lifting handle at the second end of the multilayer strap;

said first second, third, and fourth lifting handles being vertically alignable;

a first layer with:

a first end, the first end of the first layer defining, at least in part, the first lifting handle, and a second end, the second end of the first layer defining, at least in part, the second lifting handle, a second layer with:

a first end, the first end of the second layer defining, at least in part, the third lifting handle, and a second end, the second end of the second layer defining, at least in part, the fourth lifting handle; and a third layer with a first end and a second end, said third layer disposed intermediate said first layer and said second layer, said first end of said third layer defining a peeling handle, the peeling handle being disposed between the first layer and the second layer; and said multi-layer strap being wrapped around said stack such that one of said first end of said multi-layer strap and said second end of said multi-layer strap is overlapping the other of said first end and said second end of said multi-layer strap, whereby pulling the peeling handle pulls the first end of the third layer, pulling the first layer and second layer inward upon themselves.

25. A package of sheet media comprising:

a stack of individual sheets of sheet media, said stack including a stack width, a stack height and a stack length;

a multi-layer strap with a first end and a second end, said multi-layer strap including:

a first layer with a first end and a second end, said first layer being at least the length of the multi-layer strap, a second layer with a first end and a second end, said first end of said first layer and said first end of said second layer defining said first end of said multi-layer strap, said second layer being at least the length of the multi-layer strap, and a third layer with a first end and a second end, said third layer disposed intermediate said first layer and said second layer, the first end of said third layer having a peeling handle, the peeling handle being disposed between the first layer and second layer, and said second end of said third layer connected to said second end of said first layer and said second end of said second layer; and said multi-layer strap being wrapped around said stack such that one of said first end of said multi-layer strap and said second end of said multi-layer strap is overlapping the other of said first end and said second end of said multi-layer strap, whereby pulling the peeling handle pulls the first end of the third layer, pulling the first layer and second layer inward upon themselves.

* * * * *